US009765676B2

(12) United States Patent
Müller et al.

(10) Patent No.: US 9,765,676 B2
(45) Date of Patent: Sep. 19, 2017

(54) EXHAUST GAS SYSTEM OF A MOTOR VEHICLE

(71) Applicant: Dr. Ing. h.c. F. Porsche Aktiengesellschaft, Stuttgart (DE)

(72) Inventors: Bernd Müller, Wiernsheim (DE); Markus Menzel, Kandel (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 14/967,853

(22) Filed: Dec. 14, 2015

(65) Prior Publication Data

US 2016/0169078 A1 Jun. 16, 2016

(30) Foreign Application Priority Data

Dec. 15, 2014 (DE) ..... 10 2014 118 633

(51) Int. Cl.
*F01N 1/00* (2006.01)
*F01N 13/08* (2010.01)
(Continued)

(52) U.S. Cl.
CPC ..... *F01N 13/08* (2013.01); *F01N 1/02* (2013.01); *F01N 13/04* (2013.01);
(Continued)

(58) Field of Classification Search
CPC . F01N 13/08; F01N 13/04; F01N 1/02; F01N 2470/16
(Continued)

(56) References Cited

U.S. PATENT DOCUMENTS 5,325,666 A 7/1994 Rutschmann
7,438,157 B2 10/2008 Schorn
(Continued)

FOREIGN PATENT DOCUMENTS

DE 102009032213 1/2011
DE 102009032214 1/2011
(Continued)

OTHER PUBLICATIONS

Great Britain Combined Search and Examination Report for GB Application No. 1520893.7. dated May 18, 2016.
(Continued)

*Primary Examiner* — Jason Shanske
(74) *Attorney, Agent, or Firm* — RatnerPrestia

(57) ABSTRACT

An exhaust gas system of a motor vehicle which has an internal combustion engine with a plurality of cylinder groups, with a first exhaust gas section which is assigned to a first cylinder group of the internal combustion engine, and with a second exhaust gas section which is assigned to a second cylinder group of the internal combustion engine, each exhaust gas section comprising in each case one exhaust gas purification device, and a common silencer interacting with the first exhaust gas section and the second exhaust gas section, namely in such a way that, starting from the exhaust gas purification device of the first exhaust gas section and starting from the exhaust gas purification device of the second exhaust gas section, in each case, a first part exhaust gas section opens into an interior of the common silencer.

6 Claims, 1 Drawing Sheet

(51) Int. Cl.
*F01N 13/04* (2010.01)
*F01N 1/02* (2006.01)

(52) U.S. Cl.
CPC ..... *F01N 2210/04* (2013.01); *F01N 2470/02* (2013.01); *F01N 2470/14* (2013.01); *F01N 2470/16* (2013.01); *F01N 2490/00* (2013.01); *F01N 2490/15* (2013.01)

(58) Field of Classification Search
USPC ..... 60/324, 323
See application file for complete search history.

(56) References Cited

U.S. PATENT DOCUMENTS

| | | | | |
|---|---|---|---|---|
| 8,418,445 | B2 | 4/2013 | Laube | |
| 2011/0000186 | A1* | 1/2011 | Laube | F01N 1/00 60/272 |
| 2011/0000201 | A1* | 1/2011 | Laube | F01N 1/166 60/324 |

FOREIGN PATENT DOCUMENTS

| | | |
|---|---|---|
| DE | 102013208946 | 11/2014 |
| EP | 1686246 | 4/2012 |
| JP | 2010255519 | 11/2010 |

OTHER PUBLICATIONS

German Search Report for German Application No. 10 2014 118 633.8 mailed Apr. 29, 2015, including partial translation.

* cited by examiner

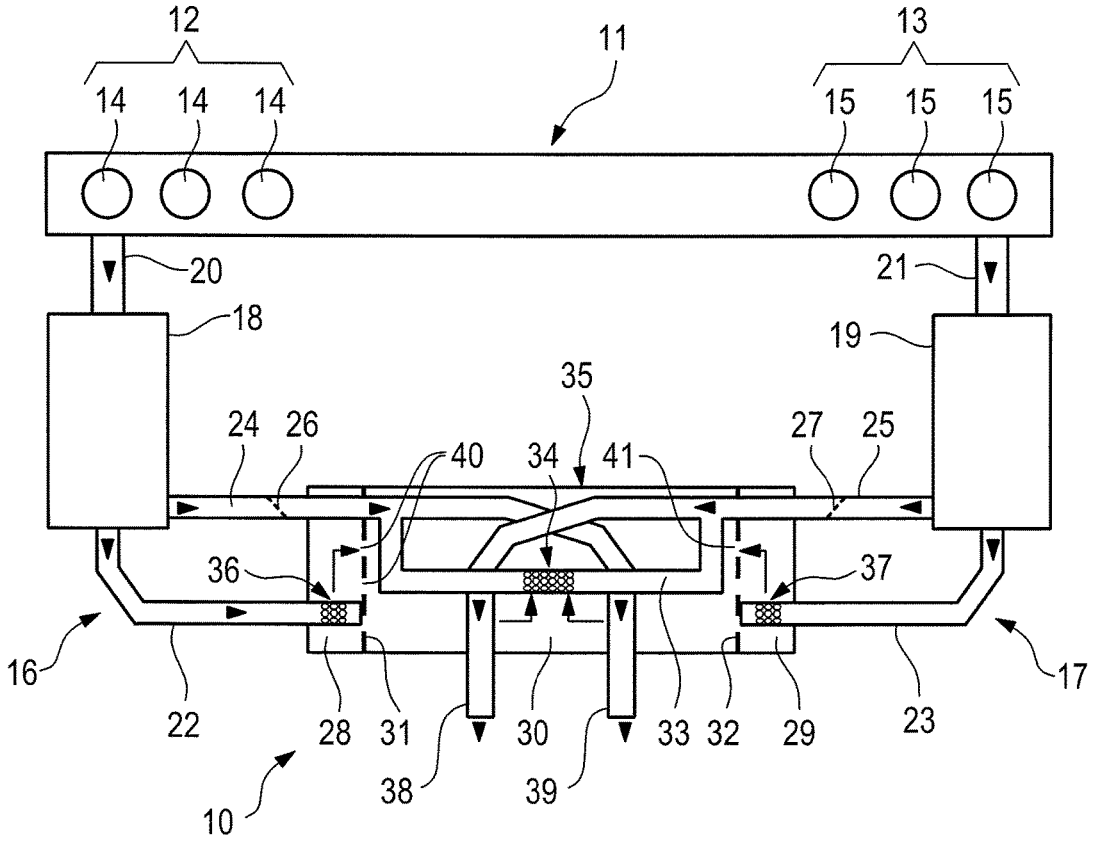
12
11
13
14
14
14
15
15
15
20
21
18
19
35
24
26
40
34
41
27
25
36
37
16
17
22
28
31
30
33
32
29
23
38
39
10

EXHAUST GAS SYSTEM OF A MOTOR VEHICLE

CROSS-REFERENCE TO RELATED APPLICATION

This application claims priority to German Patent Application No. DE 10 2014 118 633.8, filed Dec. 15, 2014, which is incorporated by reference herein in its entirety.

FIELD OF THE INVENTION

The invention relates to an exhaust gas system, which has an internal combustion engine with a plurality of cylinder groups, with a first exhaust gas section which is assigned to a first cylinder group of the internal combustion engine, and with a second exhaust gas section which is assigned to a second cylinder group of the internal combustion engine, each exhaust gas section comprising in each case one exhaust gas purification device.

BACKGROUND OF THE INVENTION

DE 10 2009 032 214 A1, which is incorporated by reference herein, has disclosed an exhaust gas system with a first exhaust gas section which is assigned to a first cylinder group of an internal combustion engine and with a second exhaust gas section which is assigned to a second cylinder group of the internal combustion engine, each exhaust gas section comprising in each case one exhaust gas purification device, in each case one first silencer which is arranged downstream of the respective exhaust gas purification device, and in each case one second silencer which is arranged downstream of the respective first silencer. Each exhaust gas section comprises in each case one bypass line, it being possible for exhaust gas to be discharged via each bypass line starting from the respective first silencer, bypassing the second silencer, and the bypass lines and therefore the first silences of both exhaust gas sections being connected to one another via a mixing line.

EP 1 686 246 B1, which is incorporated by reference herein, has disclosed a silencer for an exhaust gas system. A first exhaust gas pipe opens into the interior of the silencer. A second exhaust gas pipe leads through the interior of the silencer, the second exhaust gas pipe being coupled via openings to the interior of the silencer.

SUMMARY OF THE INVENTION

Proceeding herefrom, the invention relates to providing a novel exhaust gas system of a motor vehicle and a motor vehicle having an exhaust gas system of this type.

According to aspects of the invention, a common silencer interacts with the first exhaust gas section and the second exhaust gas section, namely in such a way that, starting from the exhaust gas purification device of the first exhaust gas section and starting from the exhaust gas purification device of the second exhaust gas section, in each case a first part exhaust gas section of the respective exhaust gas section opens into an interior of the common silencer, that, starting from the exhaust gas purification device of the first exhaust gas section and starting from the exhaust gas purification device of the second exhaust gas section, in each case a second part exhaust gas section of the respective exhaust gas section leads through the common silencer and opens into the open air, and that the second part exhaust gas sections of the first exhaust gas section and the second exhaust gas section are coupled by an exhaust gas coupling line which is coupled via at least one opening to the interior of the common silencer.

By way of the exhaust gas system according to aspects of the invention, the internal combustion engine of a motor vehicle can be operated with a high degree of efficiency and low noise emissions with a simple construction of the exhaust gas system. With low outlay, it is possible to optimize a gas exchange of the internal combustion engine which is assigned an exhaust gas system of this type and therefore the degree of efficiency of the internal combustion engine. Furthermore, legal standards for noise emissions can be adhered to using simple means.

As viewed in the flow direction of the exhaust gas, in each case one shut-off element preferably interacts with the respective second part exhaust gas section downstream of the respective exhaust gas purification device and upstream of an attachment point of the exhaust gas coupling line. This is advantageous with regard to gas exchanges of the internal combustion engine.

According to one advantageous development, the interior of the common silencer is divided into a first chamber, a second chamber and a third chamber, namely in such a way that in each case one dividing wall with in each case at least one opening is arranged between the first chamber and the third chamber and between the second chamber and the third chamber, with the result that the first chamber and the second chamber are coupled in each case to the third chamber. The first part exhaust gas section of the first exhaust gas section preferably opens into the first chamber of the interior of the common silencer, the first part exhaust gas section of the second exhaust gas section opening into the second chamber of the interior of the common silencer, and the exhaust gas coupling line being coupled via the or each opening thereof to the third chamber of the interior of the common silencer. With a simple construction of the exhaust gas system, the internal combustion engine of the motor vehicle can be operated with a high degree of efficiency and low noise emissions. Legal standards for noise emissions can be adhered to using simple means.

According to a further advantageous development, the exhaust gas system comprises a single common silencer for the first exhaust gas section and the second exhaust gas section, exclusively the second part exhaust gas sections of the first exhaust gas section and the second exhaust gas section opening directly into the open air. With a simple construction of the exhaust gas system, the internal combustion engine of the motor vehicle can be operated with a high degree of efficiency and low noise emissions. Legal standards for noise emissions can be adhered to using simple means.

According to aspects of the invention, the above-described exhaust system can be incorporated into a motor vehicle.

BRIEF DESCRIPTION OF THE DRAWING

The FIGURE shows a block circuit diagram of an exhaust gas system according to aspects of the invention of a motor vehicle together with an internal combustion engine of the motor vehicle.

DETAILED DESCRIPTION OF THE INVENTION

The present invention relates to an exhaust gas system of a motor vehicle and to a motor vehicle having an exhaust gas system of this type.

The FIGURE diagrammatically shows one preferred exemplary embodiment of an exhaust gas system 10 according to aspects of the invention together with an internal combustion engine 11. The internal combustion engine 11 comprises a plurality of cylinder groups 12, 13, each of the cylinder groups 12, 13 comprising in each case three cylinders 14 and 15, respectively, in the exemplary embodiment which is shown. It is to be noted that it goes without saying that the number of cylinders 14, 15 per cylinder group 12, 13 can differ herefrom.

A first exhaust gas section 16 interacts with the first cylinder group 12 of the internal combustion engine 11 and a second exhaust gas section 17 interacts with the second cylinder group 13. Each exhaust gas section 16, 17 comprises in each case one exhaust gas purification device 18 and 19, respectively. The exhaust gas of the respective cylinder group 12 and 13 is fed via an exhaust gas line 20 and 21, respectively, of the respective exhaust gas section 16 and 17 to the respective exhaust gas purification device 18 and 19 of the respective exhaust gas section 16 and 17.

A common silencer 35 interacts with both exhaust gas sections 16, 17.

Said common silencer 35 for both exhaust gas sections 16, 17 interacts with the exhaust gas sections 16 and 17 in such a way that, starting from the respective exhaust gas purification device 18 of the first exhaust gas section 16 and starting from the respective exhaust gas purification device 19 of the second exhaust gas section 17, in each case a first part exhaust gas section 22 and 23, respectively, of the respective exhaust gas section 16 and 17 opens into an interior of the common silencer 35.

Furthermore, starting from the respective exhaust gas purification device 18 of the first exhaust gas section 16 and starting from the respective exhaust gas purification device 19 of the second exhaust gas section 17, in each case a second part exhaust gas section 24 and 25, respectively, of the respective exhaust gas section 16 and 17 extends through the common silencer 35 and opens directly into the open air.

The second part exhaust gas sections 24 and 25 of the first exhaust gas section 16 and the second exhaust gas section 17 are coupled by an exhaust gas coupling line 33, said exhaust gas coupling line 33 being coupled via at least one opening 34 to the interior of the common silencer 35.

The interior of the common silencer 35 is divided into a plurality of chambers 28, 29 and 30. A first dividing wall 31 is positioned between a first chamber 28, into which the first part exhaust gas section 22 of the first exhaust gas section 16 opens, and a third chamber 30, the first chamber 28 being coupled via at least one opening 40 in said first dividing wall 31 to the third chamber 30.

A second dividing wall 32 is positioned between a second chamber 29 and the third chamber 30 of the interior of the common silencer 35, which second dividing wall 32 likewise has at least one opening 41, via which the second chamber 29 is coupled to the third chamber 30 of the interior of the common silencer 35. Here, the first part exhaust gas section 23 of the second exhaust gas section 17 opens into the second chamber 29 of the interior of the common silencer 35.

As has already been stated, the two second part exhaust gas sections 24 and 25 of the two exhaust gas sections 16 and 17 are coupled via the exhaust gas coupling line 33, the exhaust gas coupling line 33 communicating or being coupled via the or each opening 34 thereof with/to the third chamber 30 of the interior of the common silencer 35.

Here, the third chamber 30 of the interior of the common silencer 35 is positioned between the first chamber 28 of the common silencer 35 and the second chamber 29 thereof.

As viewed in the flow direction of the exhaust gas, in each case one shut-off element 26 and 27, respectively, interacts with each second part exhaust gas section 24, 25 of the exhaust gas sections 16, 17, the respective shut-off element 26 and 27 being positioned downstream of the respective exhaust gas purification device 18 and 19 and upstream of an attachment region of the exhaust gas coupling line 33 to the respective second part exhaust gas section 24 and 25. Via the respective shut-off element 26 and 27, the exhaust gas flow through the respective second part exhaust gas section 24 and 25 of the first exhaust gas section 16 and second exhaust gas section 17 can be opened or shut.

As has already been stated, the first part exhaust gas sections 22, 23 of the two exhaust gas sections 16, 17 open into the corresponding first and second chambers 28, 29 of the interior of the common silencer 35, namely in each case via at least one opening 36 and 37, respectively, in a circumferential face of a respective exhaust gas pipe which provides the respective first part exhaust gas section 22 and 23.

The or each opening 34 of the exhaust gas coupling line 33 is likewise made in a circumferential face of the latter.

When relatively little exhaust gas accumulates in the region of the cylinder groups 12, 13 of the internal combustion engine 11, the shut-off devices 26, 27 which are assigned to the second part exhaust gas sections 24 and 25 upstream of the exhaust gas coupling line attachment regions are preferably closed, with the result that the entire exhaust gas then flows via the first part exhaust gas lines 22 and 23 of the exhaust gas sections 16, 17 into the interior of the common silencer 35, in order then to flow via the openings 34 in the exhaust gas coupling line 33 into the latter and to flow via those sections of the second part exhaust gas sections 24 and 25 which run downstream of the shut-off devices 26 and 27 into the open air. In this case, the entire exhaust gas quantity is guided via the interior of the common silencer 35.

When a relatively great exhaust gas quantity accumulates in the region of the cylinder groups 12, 13 of the internal combustion engine 11, the shut-off devices 26, 27 are preferably open, with the result that a first exhaust gas part quantity flows directly via the second part exhaust gas sections 24, 25 into the open air, and a second part exhaust gas quantity being guided via the interior of the common silencer 35 and the exhaust gas coupling line 33.

The exhaust gas system 10 preferably has a single silencer 35 which interacts with both exhaust gas sections 16, 17. Exclusively the second part exhaust gas sections 24 and 25 of the exhaust gas sections 16 and 17 open via corresponding outlet pipes 38, 39 directly into the open air. The exhaust gas coupling line 33 makes a crossflow between the exhaust gas sections 16 and 17 possible. The exhaust gas system 10 has a simple construction and makes the operation of a motor vehicle with a high degree of efficiency and low noise emissions possible using simple means.

The dividing walls 31, 32 between the chambers 28 and 30 and the chambers 29 and 30 permit advantageous setting of the silencing action of the silencer 35.

When both shut-off elements 26 and 27 are closed, the entire exhaust gas is fed via the interior of the common silencer 35.

When the shut-off elements 26 and 27 are open, as viewed starting from the two exhaust gas purification devices 18, 19, the exhaust gas is divided into four part exhaust gas sections, said exhaust gas being discharged merely via two outlet pipes 38 and 39 into the surroundings, however.

What is claimed is:

1. An exhaust gas system (10) of a motor vehicle which has an internal combustion engine (11) with a plurality of cylinder groups (12, 13), the exhaust gas system comprising:

a first exhaust gas section (16) assigned to a first cylinder group of the internal combustion engine, and a second exhaust gas section (17) assigned to a second cylinder group of the internal combustion engine, each exhaust gas section (16, 17) comprising one exhaust gas purification device (18, 19), and a common silencer (35) that interacts with the first exhaust gas section (16) and the second exhaust gas section (17), in such a way that, (i) starting from the exhaust gas purification device (18) of the first exhaust gas section (16) a first part exhaust gas section (22) opens into an interior of the common silencer (35), (ii) starting from the exhaust gas purification device (19) of the second exhaust gas section (17), a first part exhaust gas section (23) of the second exhaust gas section (17) opens into the interior of the common silencer (35), (iii) starting from the exhaust gas purification device (18) of the first exhaust gas section (16), a second part exhaust gas section (24) leads through the common silencer (35) and opens into the open air, (iv) starting from the exhaust gas purification device (19) of the second exhaust gas section (17), a second part exhaust gas section (25) of the second exhaust gas section (17) leads through the common silencer (35) and opens into the open air, and (v) the second part exhaust gas sections (24, 25) of the first exhaust gas section (16) and the second exhaust gas section (17) are coupled by an exhaust gas coupling line (33) which is coupled via at least one opening (34) to the interior of the common silencer (35).

2. The exhaust gas system as claimed in claim 1, wherein, as viewed in a flow direction of the exhaust gas and for each exhaust gas section (16, 17), one shut-off element (26, 27) interacts with the respective second part exhaust gas section (24, 25) downstream of the respective exhaust gas purification device (18, 19) and upstream of the exhaust gas coupling line (33).

3. The exhaust gas system as claimed in claim 1, wherein the interior of the common silencer (35) is divided into a first chamber (28), a second chamber (29) and a third chamber (30), in such a way that one dividing wall (31) with at least one opening (40) is arranged between the first chamber (28) and the third chamber (30), and another dividing wall (32) with at least one opening (41) is arranged between the second chamber (29) and the third chamber (30) with the result that the first chamber (28) and the second chamber (29) are each coupled to the third chamber (30).

4. The exhaust gas system as claimed in claim 3, wherein the first part exhaust gas section (22) of the first exhaust gas section (16) opens into the first chamber (28) of the interior of the common silencer (35), and in that the first part exhaust gas section (23) of the second exhaust gas section (17) opens into the second chamber (29) of the interior of the common silencer (35).

5. The exhaust gas system as claimed in claim 3, wherein the exhaust gas coupling line (33) is coupled via opening (34) to the third chamber (30) of the interior of the common silencer (35).

6. A motor vehicle including the exhaust gas system (10) as claimed in claim 1.

* * * * *